United States Patent [19]

Ritter

[11] Patent Number: 5,022,582

[45] Date of Patent: Jun. 11, 1991

[54] CORRUGATED BOX FLAP LOCKING FEATURE FOR PRODUCE AND THE LIKE

[75] Inventor: Karl M. Ritter, Carol Stream, Ill.

[73] Assignee: Jefferson Smurfit Corporation, St. Louis, Mo.

[21] Appl. No.: 613,287

[22] Filed: Nov. 15, 1990

[51] Int. Cl.[5] ..... B65D 5/10

[52] U.S. Cl. ..... 229/157; 229/185; 229/DIG. 4

[58] Field of Search ..... 229/156, 157, DIG. 14, 229/185

[56] References Cited

U.S. PATENT DOCUMENTS

| | | | |
|---|---|---|---|
| 3,194,480 | 7/1965 | Maindron | 229/157 |
| 4,279,377 | 7/1981 | Peeples et al. | 229/157 |
| 4,650,112 | 3/1987 | Booth | 229/157 |
| 4,821,949 | 4/1989 | Booth | 229/157 |
| 4,953,782 | 9/1990 | Noland | 229/157 |

*Primary Examiner*—Stephen Marcus
*Assistant Examiner*—Chris McDonald
*Attorney, Agent, or Firm*—Paul M. Denk

[57] ABSTRACT

A blank for forming a paperboard box has portions for forming side walls and end walls of a container and major and minor flaps which interlock to form a bottom to the container. The flaps are connected to the side and end walls along hinge lines. The major flaps include slits or slots which receive tabs on the minor flaps to maintain the bottom closed. The slit or slot of the major flap extends from the center thereof to the hinge line separating the major flap from the side wall. The hinge line between the major flat and the side wall includes pair of spaced parallel fold lines which diagonally extend from the hinge line and intersect the slit or slot. These spaced diagonal fold lines which are offset in alignment, cause the slit or slot to open when the major closure flat is folded over, thereby facilitating insertion of the tab into the slot or slit.

14 Claims, 2 Drawing Sheets

CORRUGATED BOX FLAP LOCKING FEATURE FOR PRODUCE AND THE LIKE

BACKGROUND OF THE INVENTION

This invention relates to containers made of corrugated paperboard, and more particularly to a container which is easily formed from a blank and has a locking bottom.

Paperboard cartons come in a wide variety of structures to enable them to carry heavy loads. To facilitate shipping, the containers are formed from blanks which are then formed into containers on site. Prior art blanks had a solid bottom These blanks, however, are costly and the industry is switching to blanks having side and end walls and a locking bottom formed from flaps which are hingedly connected to the side and end walls.

Booth U.S. Pat. No. 4,821,949 discloses a container blank for forming a container wherein flap locking slits are formed at the ends of a major flap. U.S. Pat. No. 4,650,112 shows earlier technology. The locking slits of Booth include a first portion and a second portion which together define a flap retaining segment and an angular slit extending angularly from the end of the second portion to provide flexibility to the flap retaining segment. Although the angular slit may provide flexibility to the flap retaining segment, it does not aid in the insertion of the flap into the flap retaining segment such as by opening the flap retaining segment. Also, the patent to Peeples U.S. Pat. No. 4,279,377, shows early related structure.

SUMMARY OF THE INVENTION

One object is to provide a paperboard blank for forming a paperboard container, wherein a tab receiving slit or slot is opened upon folding of a flap along its hingeline to facilitate insertion of a tab of a second flap therein.

Another object is to provide such a container having new shapes for tab receiving slits or slots to facilitate the folding of the container.

These and other objects will become apparent to those skilled in the art in light of the foregoing description and drawings.

In accordance with the invention, generally stated, there is provided a blank for forming a carton with a locking bottom closure. The blank includes portions for forming a pair of opposing end walls, portions for forming a pair of opposing side walls, a major closure flap hingedly connected to each side wall portion, and a minor closure flap connected to each end wall portion. The major closure flap has a fixed end hingedly adjacent the side wall portion, a free end remote from the fixed end, and tab means at said free end. The minor closure flap has tab receiving means formed at a variety of unique shapes, for receiving the major closure flap tab means. A hinge line between said end wall portion and the minor closure flap hingedly connects the minor closure flap to the end wall portion. The hinge line includes means for opening the tab receiving means to facilitate insertion of said tab means in said tab receiving means. The opening means preferably includes parallel fold lines which are angularly offset from the hinge line and which intersect or extend to the tab receiving means.

DESCRIPTION OF THE PREFERRED EMBODIMENT

Figure 1:
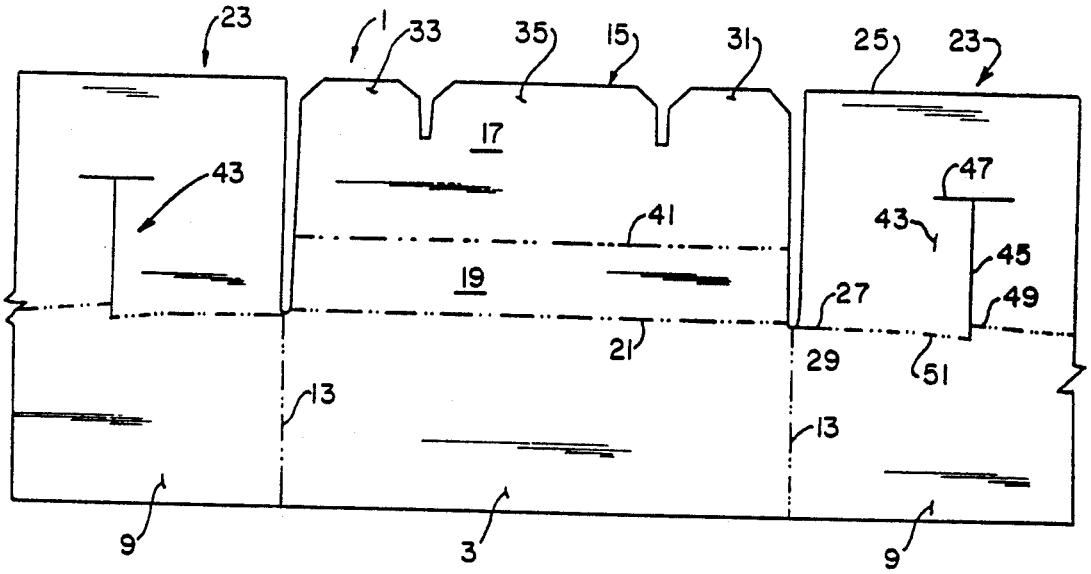
FIG. 1 is a fragmentary plan view of a blank of the present invention.
Figure 2:
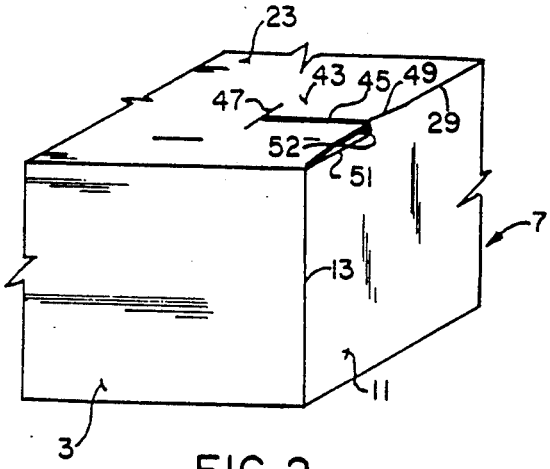
FIG. 2 is a perspective view of the blank of FIG. 1 being folded into a container.

Referring generally to FIGS. 1 and 2, there is shown a paperboard blank 1 used for forming an open topped container. Blank 1 includes portions 3 which form end walls 5 of a container 7 and portions 9 which form side walls 11 of container 7. Portions 3 and 9 are separated by hinge lines 13 which allow the portions 3 and 9 to be folded to form walls 5 and 11.

A minor closure flap 15 having a free end 17 and a fixed end 19 is connected to portion 3 at a hingeline 21. Similarly a major closure flap 23 having a free end 25 and a fixed end 27 is connected to the side portions 9 by a hinge line 29. Hinge lines 21 and 29 allow the major and minor closure flaps to fold upon themselves to form the bottom of container 7.

Figure 3:
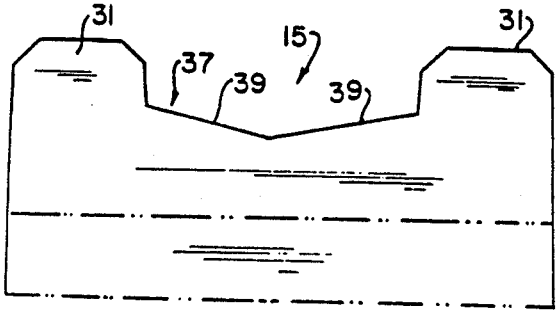
FIG. 3 is a fragmentary plan view of an alternative construction of a minor flap of the present invention.

Minor flap 15 includes tabs 31 and 33 at opposite ends of its free end 17. A tab 35 may be left between tabs 31 and 33 or, a cutout 37 having diagonal sides 39 may be formed intermediate tabs 31 (FIG. 3). Or, the cut out may be of rectangular or other shape. The fixed and free ends, 17 and 19, of minor closure flap 15 are separated by a fold line 41.

Major flaps 23 include a T-shaped slit 43 having a vertical portion 45 which extends vertically or inwardly from hinge line 29 and a horizontal slit 47 which crosses slit 45. T-shaped slit 43 receives tab 31 so that flaps 15 and 23 may be interlocked to form a strong, secure bottom to container 7. When forming the bottom of container 7, hingeline 41 allows minor closure flap 15 to bend, thereby facilitating insertion of tab 31 in slit 43.

Hingeline 29 includes parallel diagonally offset compound fold lines 49 and 51 which intersects slit 45. Fold lines 49 and 51 diverge from hinge 29 so that they are spaced apart when they intersect vertical slit 45. When major portion 23 is folded over to form the bottom of container 7, the fold lines 49 and 51 cause the slit 45 to separate creating a small spaced opening 52 with one segment of the portion raised above the other, into which tab 31 can be inserted with facility. Fold lines 49 and 51 thus accommodate entry of tab 31 into slit 43.

Figure 4:
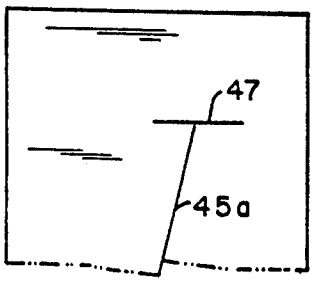
FIGS. 4–15 show various modifications that can be made to a slit or slot which receives a tab of the minor flap to lock the container bottom.
Figure 5:
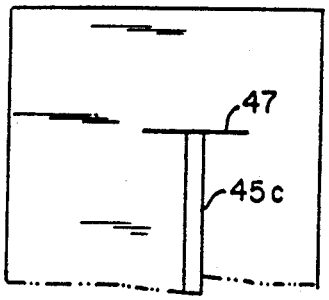
Figure 6:
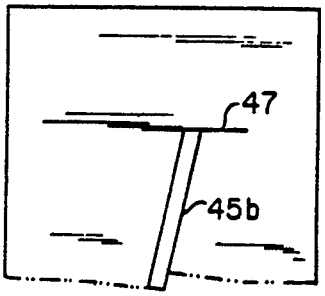
Figure 7:
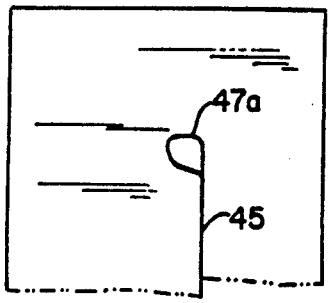
Figure 8:
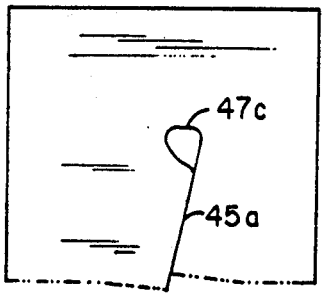
Figure 9:
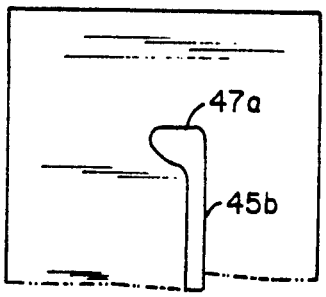
Figure 10:
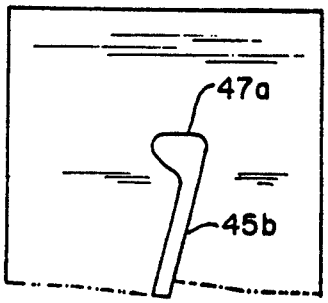
Figure 11:
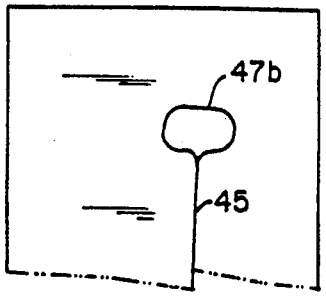
Figure 12:
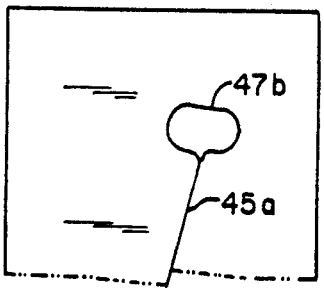
Figure 13:
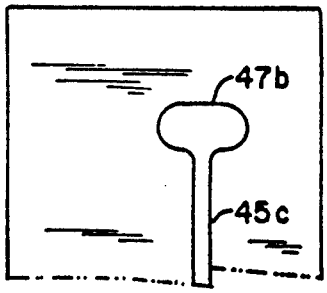
Figure 14:
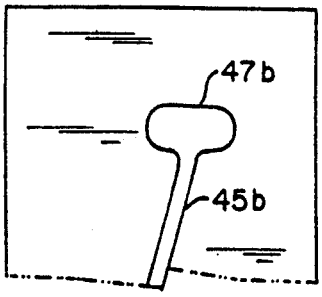
Figure 15:
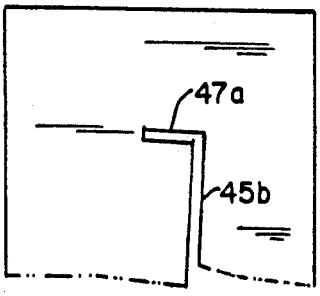

As can be seen in FIGS. 5–15, the shape of the tab receiving means 43 may be varied. The vertical slit 45 may be formed as a diagonal slit **45*a* (FIGS. 4, 8, and 12); it may be formed as a vertical slot 45*c* (FIGS. 5, 9 and 13); or it may be formed as a diagonal or other slot 45*b* (FIGS. 6, 10, 14 and 15). Slit 47 may be formed as an opening 47*a* (FIGS. 7–10) so that tab receiving means 43 resembles a musical note, or it may be formed as an ovoid opening 47*b* (FIGS. 11–14) which crosses slit 45 or 45*a* or slot 45*b* or 45*c*, so that the tab receiving means 43** somewhat resembles a child's drawing of a tree.

Numerous variations within the scope of the appended claims will be apparent to those skilled in the art in light of the foregoing description and accompanying drawings. For example, a second set of flaps could be added to the side end walls to form a top such closure for the container. This example is merely illustrative.

I claim:

1. A blank for forming a carton with a locking bottom closure comprising portions for forming a pair of opposing end walls;

portions for forming a pair of opposing side walls generally normal to said end walls;

a major closure flap hingedly connected to each said side wall portion, said major closure flap including a fixed end hingedly adjacent said side wall portion, a free end remote from said fixed end, and tab means at said free end;

a minor closure flap connected to each said end wall portion, said minor closure flap including tab receiving means for receiving said major closure flap tab means; and a hinged line between said end wall portion and said minor closure flap for hingedly connecting said minor closure flap to said end wall, said hinge line including means for opening said tab receiving means to facilitate insertion of said tab means in said tab receiving means.

2. The blank of claim 1, wherein said opening means comprises at least one score line angularly offset from said hinge line and which extends to said tab receiving means.

3. The blank of claim 2, wherein said opening means comprises a pair of diagonal score line angularly offset from said hinge line and which extend to said tab receiving means.

4. The blank of claim 1, wherein said major flap further includes a cut out between said tab means.

5. The blank of claim 1, wherein said major flap further includes a score line intermediate said fixed end and said free end.

6. The blank of claim 1, wherein said tab receiving means comprises a T-shaped slit, said slit having a vertical portion which extends upwardly from said hinge line and a horizontal top portion which crosses said vertical portion at the top thereof.

7. The blank of claim 6, wherein said vertical portion is offset from the vertical.

8. The blank of claim 6, wherein said vertical portion comprises a slot.

9. The blank of claim 1, wherein said tab receiving means comprises a vertical slit extending upward from said hinge line and an opening at the end thereof, said tab receiving mean being generally in the shape of a musical note.

10. The blank of claim 9, wherein said vertical slit is a diagonally offset from the vertical.

11. The blank of claim 9, wherein said slit is a slot.

12. The blank of claim 11, wherein said horizontal top portion is an oblong hole and crosses said vertical slot.

13. The blank of claim 1, wherein said tab receiving means comprises an L-shaped slot or slit.

14. A carton with locking bottom closure formed from a blank comprising a pair of opposing end walls;

a pair of opposing side walls generally normal to said end walls;

a major closure flap hingedly connected to each said side wall, said major closure flap including a fixed end hingedly adjacent said side wall, a free end remote from said fixed end, and tab means at said free end;

a minor closure flap connected to each of said end wall, said minor closure flap including tab receiving means for receiving said major closure flap tab means; and a hinged line between said end wall and said minor closure flap for hingedly connecting said minor closure flap to said end wall, said hinge line including means for opening said tab receiving means t facilitate insertion of said tab means in said tab receiving means.

* * * * *